US009865109B2

(12) United States Patent
Roth et al.

(10) Patent No.: US 9,865,109 B2
(45) Date of Patent: Jan. 9, 2018

(54) SYSTEMS AND METHODS FOR CONTROLLING AN ELECTRONIC LOCK FOR A REMOTE DEVICE

(71) Applicant: Chatsworth Products, Inc., Georgetown, TX (US)

(72) Inventors: Wayne D. Roth, Leander, TX (US); Donald A. Conner, Georgetown, TX (US); Ronald S. Orris, Austin, TX (US)

(73) Assignee: CHATSWORTH PRODUCTS, INC., Georgetown, TX (US)

( * ) Notice: Subject to any disclaimer, the term of this patent is extended or adjusted under 35 U.S.C. 154(b) by 0 days.

(21) Appl. No.: 15/225,509

(22) Filed: Aug. 1, 2016

(65) Prior Publication Data

US 2017/0032600 A1 Feb. 2, 2017

Related U.S. Application Data

(60) Provisional application No. 62/199,451, filed on Jul. 31, 2015.

(51) Int. Cl.
*G08C 19/00* (2006.01)
*G07C 9/00* (2006.01)

(52) U.S. Cl.
CPC ..... *G07C 9/00174* (2013.01); *G07C 9/00571* (2013.01); *G07C 2009/00753* (2013.01)

(58) Field of Classification Search
CPC . B60R 25/24; B60R 25/248; G07C 2009/008; G07C 2009/00936; G07C 9/00007; G07C 9/00039; G07C 9/00103; G07C 9/00166; G07C 9/00309; G07C 9/00571
USPC ..... 340/5.5, 5.6, 5.61, 5.64, 5.65, 5.7, 5.73
See application file for complete search history.

(56) References Cited

U.S. PATENT DOCUMENTS

2002/0180582 A1* 12/2002 Nielsen ..... G07C 9/00103 340/5.6
2007/0050051 A1 3/2007 Chang
2007/0188303 A1 8/2007 Faro et al.
2011/0258110 A1* 10/2011 Antoci ..... G06F 1/266 705/39
2012/0133510 A1 5/2012 Pierce et al.
2012/0213362 A1* 8/2012 Bliding ..... G07C 9/00309 380/44
2012/0235515 A1 9/2012 Scharnick
2014/0029198 A1 1/2014 Lozon et al.
2014/0052813 A1* 2/2014 Han ..... H04L 67/1097 709/214

(Continued)

*Primary Examiner* — Carlos E Garcia
(74) *Attorney, Agent, or Firm* — Snell & Wilmer L.L.P.

(57) ABSTRACT

A system for controlling an electronic lock of a remote device is disclosed. The system includes an input unit configured to receive a user code. The system includes a lock controller connected to the input unit and configured to transmit the user code to a power distribution unit. The system includes a memory configured to store a user access table of user codes associated with users having access to the remote device. The power distribution unit is configured to determine whether the user code is in the user access table. The power distribution unit is configured to communicate, to the lock controller, an indication to unlock the electronic lock when the user code is in the table of user codes.

18 Claims, 10 Drawing Sheets

(56) References Cited

U.S. PATENT DOCUMENTS

| | | | | |
|---|---|---|---|---|
| 2014/0266585 | A1* | 9/2014 | Chao | G07C 9/00111 340/5.61 |
| 2014/0320308 | A1* | 10/2014 | Lewis | H04Q 9/00 340/870.07 |
| 2015/0142481 | A1* | 5/2015 | McManus | G06Q 10/02 705/5 |
| 2015/0294515 | A1* | 10/2015 | Bergdale | G07C 9/00103 340/5.61 |
| 2016/0133071 | A1* | 5/2016 | Henderson | E05B 47/0001 70/277 |
| 2016/0328903 | A1* | 11/2016 | Roberts | G06K 9/00087 |

* cited by examiner

SYSTEMS AND METHODS FOR CONTROLLING AN ELECTRONIC LOCK FOR A REMOTE DEVICE

CROSS REFERENCE TO RELATED APPLICATIONS

This application claims the benefit and priority of U.S. Provisional Application No. 62/199,451, filed on Jul. 31, 2015, which is hereby incorporated by reference in its entirety.

BACKGROUND

1. Field

The present disclosure relates to a system and a method for controlling an electronic lock for a remote device, and more particularly to a system and a method for controlling an electronic lock of a cabinet that houses electronic components.

2. Description of the Related Art

A conventional cabinet, such as a server cabinet or a network cabinet, can house many electronic components and is generally secured by a mechanical lock, such as a key padlock or a combination padlock. A user who is granted access to the cabinet may be given a physical key or combination corresponding to the mechanical lock. However, if access of the user to the cabinet is changed, the physical key is lost, or the combination is forgotten, the mechanical lock must be replaced. In addition, concerns regarding keys copied without authorization or combinations shared without authorization may create security vulnerabilities. Therefore, there is a need for a method and a system for controlling an electronic lock for a remote device, such as an electronics cabinet.

SUMMARY

What is described is a system for controlling an electronic lock of a remote device. The system includes an input unit configured to receive a user code. The system also includes a lock controller connected to the input unit and configured to transmit the user code to a power distribution unit. The system also includes a memory configured to store a user access table of user codes associated with users who have access to the remote device. The power distribution unit is configured to communicate the user code to a master power distribution unit when the power distribution unit is a secondary power distribution unit. The power distribution unit is configured to determine whether the user code is in the user access table when the power distribution unit is the master power distribution unit. The power distribution unit is configured to communicate, to the lock controller, an indication to unlock the electronic lock when the user code is in the table of user codes.

Also described is a power distribution unit of a remote device having an electronic lock. The power distribution unit includes a memory configured to store a user access table of user codes associated with users who have access to the remote device. The power distribution unit also includes a cabinet control unit. The cabinet control unit is configured to receive a user code. The cabinet control unit is also configured to communicate the user code to a master power distribution unit when the power distribution unit is a secondary power distribution unit. The cabinet control unit is also configured to determine whether the user code is in the user access table when the power distribution unit is the master power distribution unit. The cabinet control unit is also configured to communicate, to a lock controller, an indication to unlock the electronic lock when the user code is in the user access table.

Also described is a method for controlling an electronic lock of a remote device. The method includes receiving by an input unit, a user code. The method also includes transmitting, by a lock controller, the user code to a power distribution unit. The method also includes storing, by a memory, a user access table of user codes associated with users who have access to the remote device. The method also includes communicating, by the power distribution unit, the user code to a master power distribution unit when the power distribution unit is a secondary power distribution unit. The method also includes determining, by the power distribution unit, whether the user code is in the user access table when the power distribution unit is the master power distribution unit. The method also includes communicating, by the power distribution unit to the lock controller, an indication to unlock the electronic lock when the user code is in the table of user codes.

BRIEF DESCRIPTION OF THE DRAWINGS

Other systems, methods, features, and advantages of the present invention will be or will become apparent to one of ordinary skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Disclosed herein are systems and methods for controlling an electronic lock of a remote device, such as a cabinet. The systems and methods provide several benefits and advantages such as being able to manage access and manage conditions of the cabinet using a user interface provided by a power distribution unit (PDU) of the cabinet. Managing aspects of the cabinet using the PDU provides benefits and advantages such as being able to control all aspects of the cabinet from a single user interface. For example, if the PDU and a cabinet management controller were separate, a user may use separate interfaces for viewing power characteristics of the PDU and managing the cabinet. In addition, electronically managing the cabinet using the network connected PDU provides the benefits and advantages of remote cabinet management and organized and consistent settings across all associated cabinets. Managing cabinet access and cabinet conditions of each cabinet individually is a physically challenging task for a human being. Using a cabinet control unit of the PDU provides administrative and computational efficiency gains. Cabinet management is made more efficient, which in turn improves conditions of computing equipment housed within the cabinet, resulting in improved performance by the computing equipment.

Figure 1:
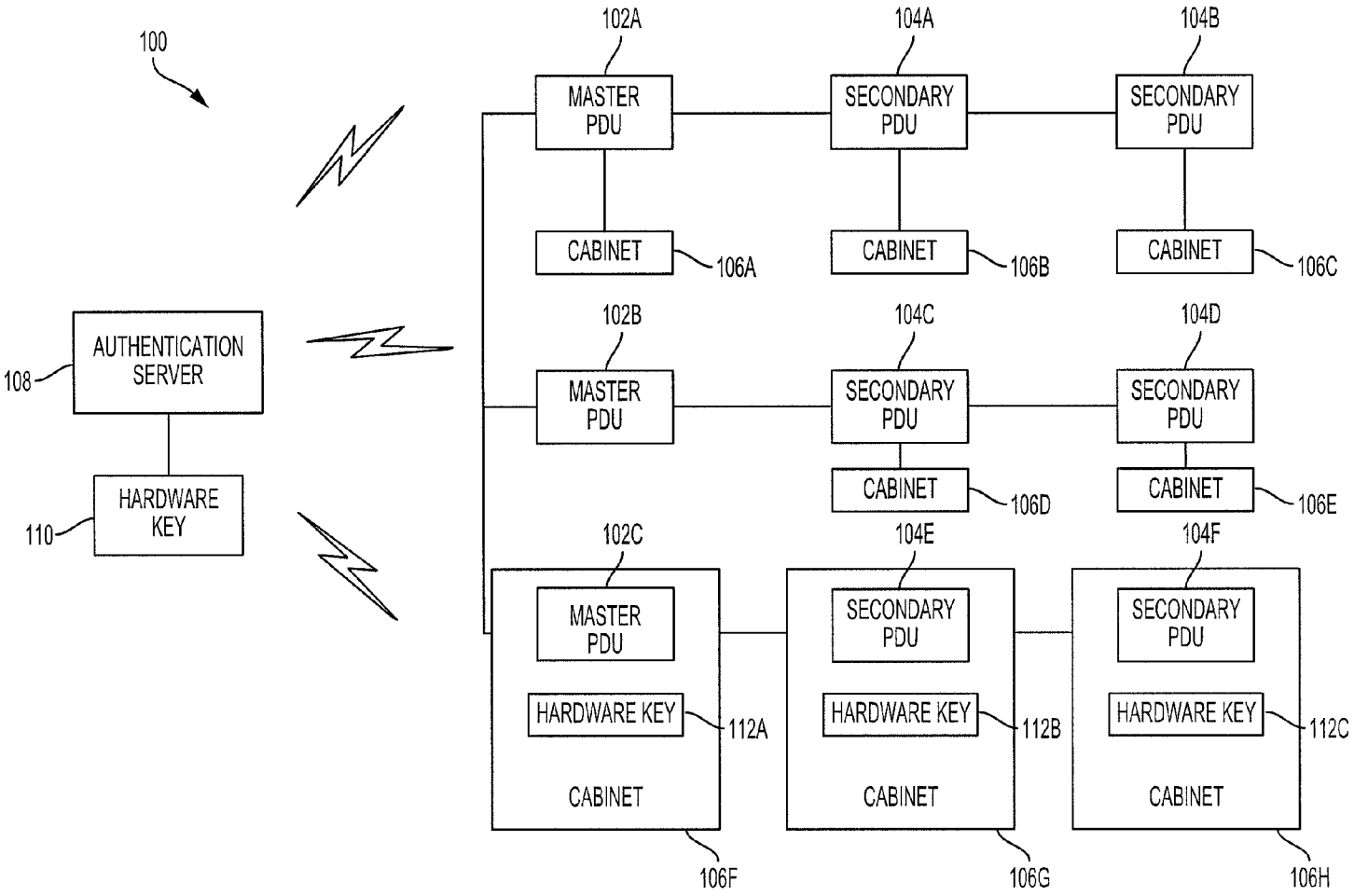
FIG. 1 depicts a block diagram of a system for controlling an electronic lock of a remote device, according to an embodiment of the invention.

FIG. 1 illustrates a block diagram of a system 100 for controlling an electronic lock of a remote device, according to an embodiment of the invention. As used herein, a single reference number may be used to generally refer to one or more elements having the reference number followed by a letter. For example, the cabinet 106 may be used when describing any of the cabinets 106A-106H or the cabinet 106 may be used to refer to all cabinets 106A-106H collectively.

The system 100 includes multiple master power distribution units (PDUs) 102 and multiple secondary PDUs 104. Both the master PDUs 102 and the secondary PDUs 104 are responsible for providing power to the cabinets 106 as well as controlling functions of the cabinet, such as regulating access to the cabinets 106 and monitoring and regulating the cabinet conditions. Power provided to the cabinets 106 may be used to power electronics housed within the cabinets 106 and may also be used to power functions of the cabinets 106. The master PDUs 102 and the secondary PDUs 104 may regulate access to respective cabinets 106 by using a user access table. In some embodiments, the user access table is stored on the master PDUs 102 only. In some embodiments, the access table is stored on the master PDUs 102 as well as the secondary PDUs 104. In some embodiments, the user access table is stored on the authentication server 108 only.

The authentication server 108 may be a server that is a part of an authentication system, such as LDAP, RADIUS, or a two-factor authentication through use of text messaging. The authentication server 108 may communicate with the master PDUs 102 via a wired or wireless network connection. The authentication server 108 may be configured to receive verification requests from a PDU. The authentication server 108 may also be configured to determine whether a user associated with the verification request has access to a particular cabinet. The authentication server 108 may be configured to communicate, to the PDU, a verification result indicating whether the user associated with the verification request has access to the particular cabinet.

A master PDU 102 may be connected to the one or more secondary PDUs 104. As described herein, a grouping of a master PDU 102, one or more secondary PDUs 104, and their respective cabinets 106 may be referred to as a row. In some embodiments, the master PDU 102 of a row is connected directly to each of the secondary PDUs 104 of the row. In some embodiments, the master PDU 102 of a row is connected to a secondary PDU 104, which is connected to another secondary PDU 104. For example, the master PDU 102A is connected to the secondary PDU 104A, which is connected to the secondary PDU 104B. The master PDU 102A may communicate with the secondary PDU 104B via the secondary PDU 104A, and the secondary PDU 104B may communicate with the master PDU 102A via the secondary PDU 104A. In some embodiments, a single communications bus, such as RS-485 or CAN Bus, connects the master PDU 102 to all secondary PDUs, allowing direct and simultaneous communications between PDUs.

When each PDU stores the access table, a master PDU 102 may communicate updates to the access tables of other master PDUs 102 via a wired or wireless network, or the secondary PDUs 104. For example, if an access table stored in the master PDU 102A is updated, the updated access table may be communicated to the secondary PDUs 104A-104B, to other master PDUs 102B-102C, and/or to the authentication server 108.

The master PDUs 102 and the secondary PDUs 104 may be separate from and connected to a respective cabinet 106, such as the master PDU 102A connected to the cabinet 106A or the secondary PDU 104A connected to the cabinet 106B. The master PDUs 102 and the secondary PDUs 104 may be integrated with, and part of their respective cabinets 106, such as the master PDU 102C being a part of the cabinet 106F and the secondary PDU 104E being a part of the cabinet 106G.

A master PDU 102, such as the master PDU 102B, may not be connected to any cabinet 106. When a master PDU 102 is not connected to a cabinet, the master PDU 102 may be responsible for providing power and managing operations of secondary PDUs 104 in the master PDU's row. In some embodiments, the master PDU 102 provides power and manages operations of the secondary PDUs 104 collectively as a group of PDUs. For example, when the temperature associated with any one of the cabinets 106 of a master PDU's row exceeds a threshold temperature, the master PDU 102 may adjust the temperature of the row of cabinets 106. In some embodiments, the master PDU 102 provides power and manages operations of secondary PDUs 104 individually. For example, a temperature may be detected for each cabinet 106. When the temperature of a particular cabinet 106 exceeds the threshold temperature, the master PDU 102 of the row may adjust the temperature of the particular cabinet 106. The master PDU 102 may manage operations of one or more associated secondary PDUs by communicating instructions to the one or more secondary PDUs to perform particular functions.

A server hardware key 110 may be connected to the authentication server 108 and corresponding cabinet hardware keys 112 may be connected to the master PDUs 102 and the secondary PDUs 104. The cabinet hardware keys 112 may be paired with a server hardware key 110, such that communication made between the authentication server 108 and a PDU 102-104 are further encrypted.

The PDUs may use the cabinet hardware key to decrypt communications from the authentication server 108, and the authentication server 108 may use the server hardware key 110 to decrypt communications from the PDUs 102-104. In some embodiments, the server hardware key 110 and the cabinet hardware key 112 are encryption chips configured to encrypt and decrypt communications. In some embodiments, the authentication server 108 and the server hardware key 110 are on a single server device. In some embodiments, the server device storing the authentication server 108 and the server hardware key 110 is a USB flash drive. In these embodiments, a computing device executing software configured to facilitate communication between the computing device and the PDUs 102-104 is able to communicate with the PDUs 102-104 only when the server device is connected to the computing device.

The server hardware key 110 and the cabinet hardware keys 112 may be periodically updated. The authentication server 108 may update the server hardware key 110 and communicate the update to the master server 102C, which updates the cabinet hardware key 112A.

Figure 2A:
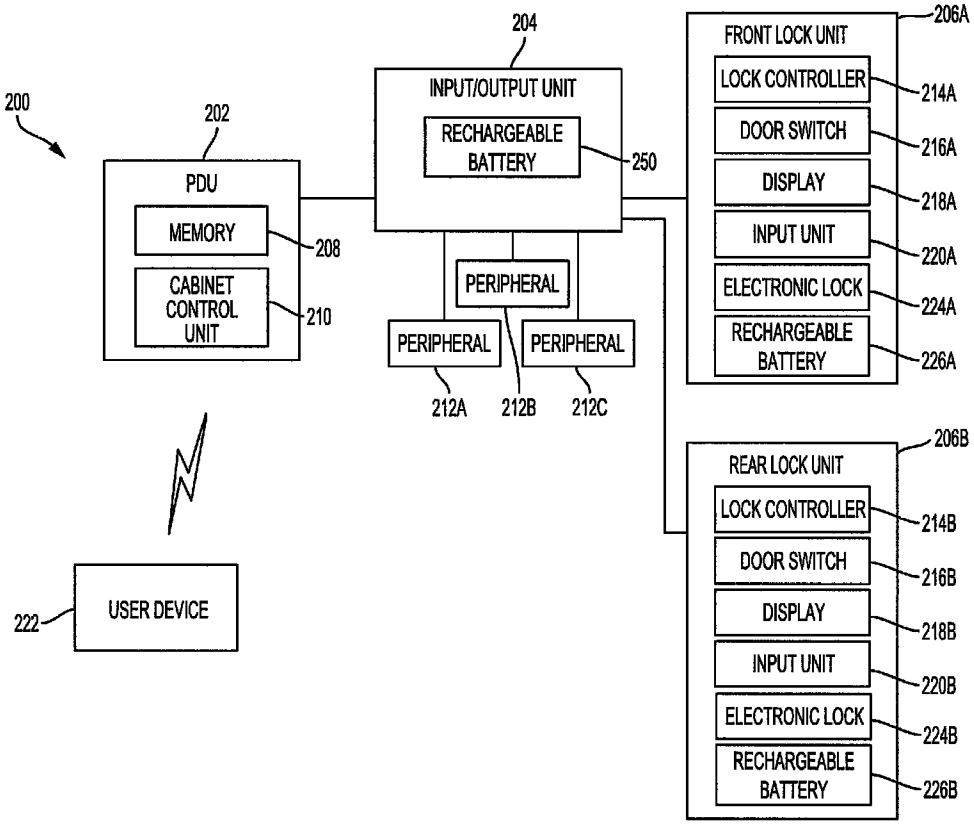
FIG. 2A depicts a block diagram of a remote device with an input/output unit, according to an embodiment of the invention.

FIG. 2A illustrates a block diagram of a cabinet 200, according to an embodiment of the invention. The cabinet 200 may include a PDU 202, an input/output unit 204, a front lock unit 206A and a rear lock unit 206B.

The PDU 202 may be a master PDU 102 or a secondary PDU 104, as described herein. The input/output unit 204 is connected to the PDU 202 and the front lock unit 206A and the rear lock unit 206B. The input/output unit 204 may also be physically contained within the PDU 202 and may include a rechargeable battery 250 used to power the input/output unit 204 in case of power interruption. The input/output unit 204 is configured to facilitate communication of data between the PDU 102 and the front lock unit 206A, and between the PDU 102 and the rear lock unit 206B. In some embodiments, the PDU 202, the input/output unit 204, the front lock unit 206A, and the rear lock unit 206B are all connected to a communications network, such as a CAN bus, and communicate via the communications network. In some embodiments, the PDU 202 is connected to the input/output unit 204 via a standardized communications interface, such as USB, serial, or Ethernet, and the input/output unit 204, the front lock unit 206A, and the rear lock unit 206B are all connected to a communications network and communicate via the communications network. In some embodiments, the PDU 202 is connected to the input/output unit 204 via a standardized communications interface such as USB, serial, or Ethernet, and the input/output unit 204 is connected to the front lock unit 206A and the rear lock unit 206B via a standardized communications protocol.

The input/output unit 204 is also connected to the one or more peripherals 212. The peripherals 212 may be sensors configured to detect data associated with the cabinet 200 and/or control units configured to control various aspects of the cabinet 200. The cabinet control unit 210 of the PDU 202 may instruct the peripherals 212 to adjust respective properties or characteristics of the cabinet 200 using respective control units.

The peripherals 212 may include a temperature sensor and a temperature control unit configured to adjust a temperature within the cabinet 200. The temperature control unit may provide air that is warmer or colder than the current temperature detected by the temperature sensor, to achieve a target temperature. The temperature control unit may adjust an amount of warm or cold air entering the cabinet 200 by adjusting a setting of an air plenum.

The peripherals 212 may include an air flow sensor and an air control unit configured to adjust an air flow within the cabinet 200. The air control unit may provide air of any temperature to achieve a target air flow based on the current air flow detected by the air flow sensor. The air control unit may adjust an amount of air entering the cabinet 200 by adjusting a setting of an air plenum.

The peripherals 212 may include a humidity sensor and a humidity control unit configured to adjust humidity within the cabinet 200. The humidity control unit may provide humidity or remove humidity to achieve a target humidity based on the current humidity of the cabinet 200 detected by the humidity sensor.

The peripherals 212 may also include a switch, such as a door switch configured to open one or more lock unit 206 by instructing the corresponding electronic lock 224 to unlock.

The front lock unit 206A and the rear lock unit 206B have similar components that are numbered similarly. Each lock unit 206 includes, for example, a lock controller 214, a door switch 216, a display 218, an input unit 220, an electronic lock 224, and a rechargeable battery 226. The display 218 may include an alpha-numeric representation and/or a graphical depiction, or may be composed of individual colored indicator lights or LEDs. The front lock unit 206A may be located on a front side of the cabinet 200 and the rear lock unit 206B may be located on a rear side of the cabinet 200. While two lock units (the front lock unit 206A and the rear lock unit 206B) are shown in FIG. 2A, any number of lock units corresponding to any number of cabinet access points may be included. For example, if the cabinet 200 has openings in the front, rear, left side, and right side, four lock units may be included in the cabinet 200, each communicating with the input/output unit 204.

The front lock unit 206A and the rear lock unit 206B may draw power from the PDU 202 via the input/output unit 204. The front lock unit 206A and the rear lock unit 206B may each also include a rechargeable power source, such as a rechargeable battery 226, to be used in a situation where power from the PDU 202 is interrupted, such that security of the cabinet 200 may be maintained.

The input unit 220 may be any input device configured to receive an input from a user. The input unit 220 may be a keypad, a card reader, a scanner, a camera, or a microphone. The input unit 220 is configured to receive a user code. The user code may be a series of letters and/or numbers and/or symbols entered into a keypad. The user code may be stored or printed on a card and read by the input unit 220. For example, the user code may be programmed into a programmable chip on a card, stored on a magnetic strip on a card, printed on a card as a series of letters, numbers, and/or symbols, or a barcode. The user code may be a phrase spoken by the user and analyzed by the input unit 220.

The memory 208 of the PDU 202 may store a user access table of user codes associated with users who have access to the cabinet 200. In an exemplary operation of a system using the cabinet 200, the lock controller 214 receives the user code from the input unit and communicates the user code to the input/output unit 204. The input/output unit 204 receives, from the lock unit 206, the user code and communicates, to the cabinet control unit 210, the user code. The cabinet control unit 210 receives the user code from the input/output unit 204 and determines whether the user code is in the user access table stored in the memory 208. The memory 208 may also store a log of user codes received from the lock controller 214.

When the user code is in the user access table, the cabinet control unit 210 communicates, to the input/output unit 204, an indication to unlock the cabinet 200. The input/output unit 204 receives, from the cabinet control unit 210, the indication to unlock the cabinet 200. The input/output unit 204 communicates, to the lock controller 214, the indication to unlock the cabinet 200. The lock controller 214 receives, from the input/output unit 204, the indication to unlock the cabinet 200. The lock controller 214 activates the door switch 216 based on the received indication to unlock the cabinet 200, and the electronic lock 224 is unlocked, causing cabinet 200 to be unlocked.

When the user code is not in the user access table, the cabinet control unit 210 communicates to the lock controller 214, a user feedback indication via the input/output unit 204.

The user feedback indication may be a display regarding denial of access using the display 218, or the user feedback indication may be a communication to security or administrator regarding the denial of access.

The cabinet control unit 210 may include one or more processors configured to perform functions described herein. The cabinet control unit 210 may determine whether the user associated with the user code has access to the cabinet 200 using the authentication server 108. The determination using the authentication server 108 may be made in addition to or in lieu of determining whether the user has access to the cabinet 200 based on the user access table stored in the memory 208. In some embodiments, the user code being in the user access table is a first access verification step, and the user identifier being verified by the authentication server 108 is a second access verification step. In some embodiments, the user identifier is verified by the authentication server 108 when the user code is not in the user access table.

In an exemplary operation, the cabinet control unit 210 receives the user code (from the lock controller 214 via the input/output unit 204) and determines a user identifier based on the user code. The memory 208 of the PDU 202 may store a user identifier table providing the user identifier based on a given user code. For example, if the user code is a scanned value of DM5BW36, the user identifier table may indicate that DM5BW36 is associated with a user identifier of Jonathan_Doe. The cabinet control unit 210 communicates a verification request including the user identifier to the authentication server 108, and receives a verification response from the authentication server 108. When the verification response indicates that the user associated with the user identifier of Jonathan_Doe is authorized to access the cabinet 200, the cabinet control unit 210 of the PDU 202 communicates an indication to the lock unit 206, via the input/output unit 204, to unlock the corresponding door switch 216. The display 218 may display an indication of whether access is granted or denied.

The PDU 202 may be configured using the input unit 220 and the display 218. The PDU 202 may be configured by a user device 222 connected to the PDU 202. The user device 222 may be connected to the PDU 202 by a wired or wireless connection. The user device 222 may be any device configured to facilitate communication between a user and the PDU 202, such as a laptop, a smartphone, a desktop computer, or a tablet computer. The cabinet control unit 210 of the PDU 202 may provide a graphical user interface which is used by a user to configure the PDU 202. The graphical user interface may be a web-based user interface, accessible by web browsing software on the user device 222. The user may adjust aspects of the peripherals 212 via the graphical user interface and the user device 222. For example, the user may adjust a target temperature for the cabinet 200, a target air flow of the cabinet 200, and/or a target humidity of the cabinet 200. The user may also modify the user identifier table or the user access table stored in the memory 208, via the user device 222 and the graphical user interface provided by the cabinet control unit 210.

The user may also adjust, using the graphical user interface, a protocol for when the network connection is interrupted and the PDU 202 is unable to communicate with other PDUs and/or the authentication server 108. In these situations, the cabinet control unit 210 may be instructed to continue operation using the stored user access table. The cabinet control unit 210 may be instructed to lock the cabinet 200 (by locking electronic lock 224) until the network connection is restored. The cabinet control unit 210 may be instructed to unlock the cabinet 200 (by unlocking electronic lock 224) until the network connection is restored.

The user may also adjust, using the graphical user interface, a protocol for when power is interrupted to the cabinet 200. In these situations, the cabinet control unit 210 may be instructed to maintain a current access state of the cabinet (e.g., remain unlocked if currently unlocked, remain locked if currently locked). The cabinet control unit 210 may be instructed to lock and/or unlock the cabinet 200 until power is restored.

The user may also adjust, using the graphical user interface, an amount of time the cabinet 200 is unlocked when access is granted. The cabinet control unit 210 may also instruct the lock unit 206 to disable the input unit 220 when the cabinet 200 is opened without authorization.

As described herein, when an adjustment is made to the PDU 202, such as an adjustment to the user access table or an adjustment to an aspect of the cabinet 200, the adjustment may be communicated to other PDUs, such as the master PDUs 102 or the secondary PDUs 104. By communicating the adjustments to the other PDUs, the user does not have to connect the user device 222 to every other PDU to make the same adjustments.

Figure 2B:
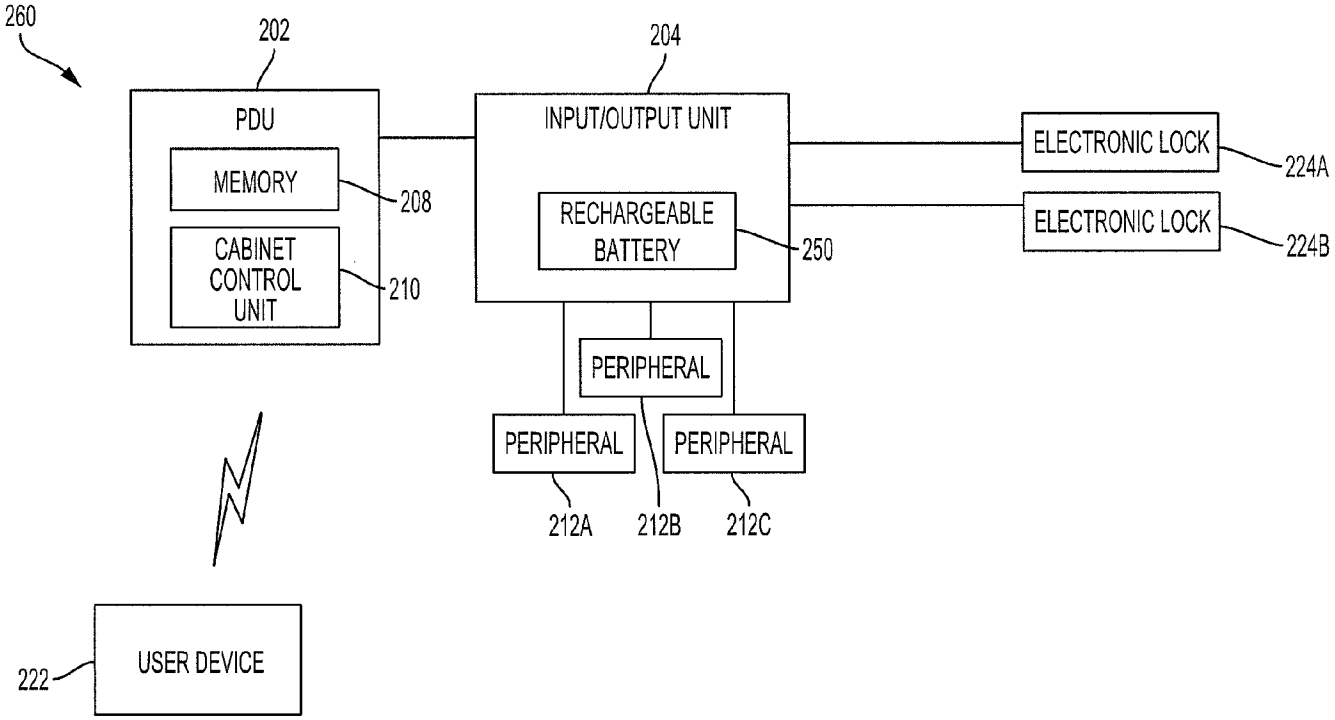
FIG. 2B depicts a block diagram of a remote device with an input/output unit, according to an embodiment of the invention.

FIG. 2B illustrates a block diagram of a cabinet 260, according to an embodiment of the invention. The cabinet 260 includes elements similar to those in the cabinet 200, and those elements are numbered similarly. The cabinet 260 includes electric locks 224, which may be a front electronic lock and a rear electronic lock, which may be locking mechanisms, such as a motor and a solenoid, and the remaining components of the lock unit 206 of the cabinet 200 (e.g., the lock controller 214, the door switch 216, the display 218, and the input unit 220) may each be peripherals 212 connected to the input/output unit 204. The cabinet 260 may otherwise operate similarly to the cabinet 200.

Figure 3:
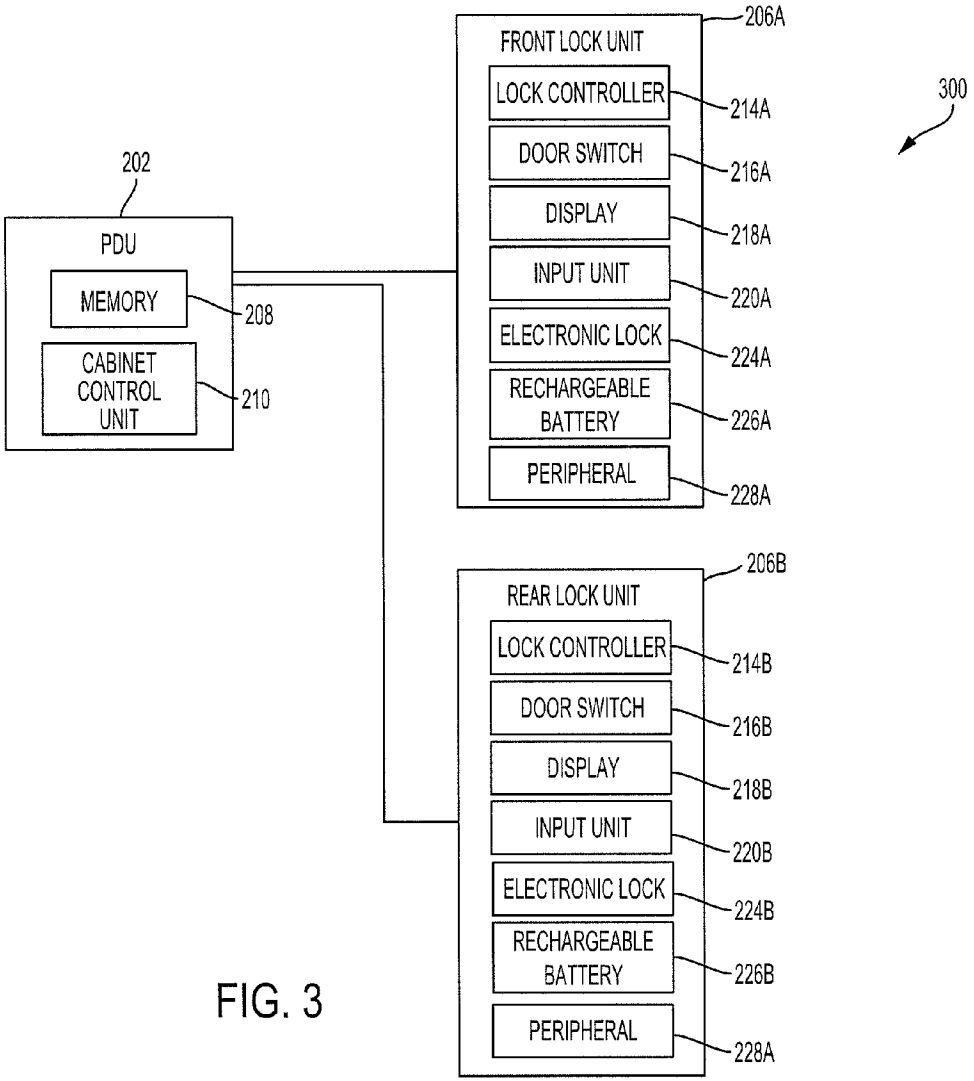
FIG. 3 depicts a further block diagram of a remote device, according to an embodiment of the invention.

FIG. 3 illustrates a block diagram of a cabinet 300, according to an embodiment of the invention. The cabinet 300 includes the PDU 202, the front lock unit 206A and the rear lock unit 206B. The lock units 206 also include one or more lock unit peripherals 228 similar to peripherals 212. The lock unit peripherals 228 may be sensors configured to detect data associated with the cabinet 300 and/or control units configured to control various aspects of the cabinet 300. The cabinet control unit 210 of the PDU 202 may instruct the lock unit peripherals 228 to adjust respective properties or characteristics of the cabinet 300 using respective control units.

The lock unit peripherals 228 may include a temperature sensor and a temperature control unit configured to adjust a temperature within the cabinet 300. The lock unit peripherals 228 may include an air flow sensor and an air control unit configured to adjust an air flow within the cabinet 300. The lock unit peripherals 228 may include a humidity sensor and a humidity control unit configured to adjust humidity within the cabinet 300.

The PDU 202 of the cabinet 300 is directly connected to the front lock unit 206A and the rear lock unit 206B. In some embodiments, the PDU 202, the front lock unit 206A and the rear lock unit 206B, may all be connected to a communications network, such as a CAN bus, and communicate over the communications network. In some embodiments, the PDU 202 is connected to the lock units 206 via a communications interface, such as USB, serial, or Ethernet.

Figure 4A:
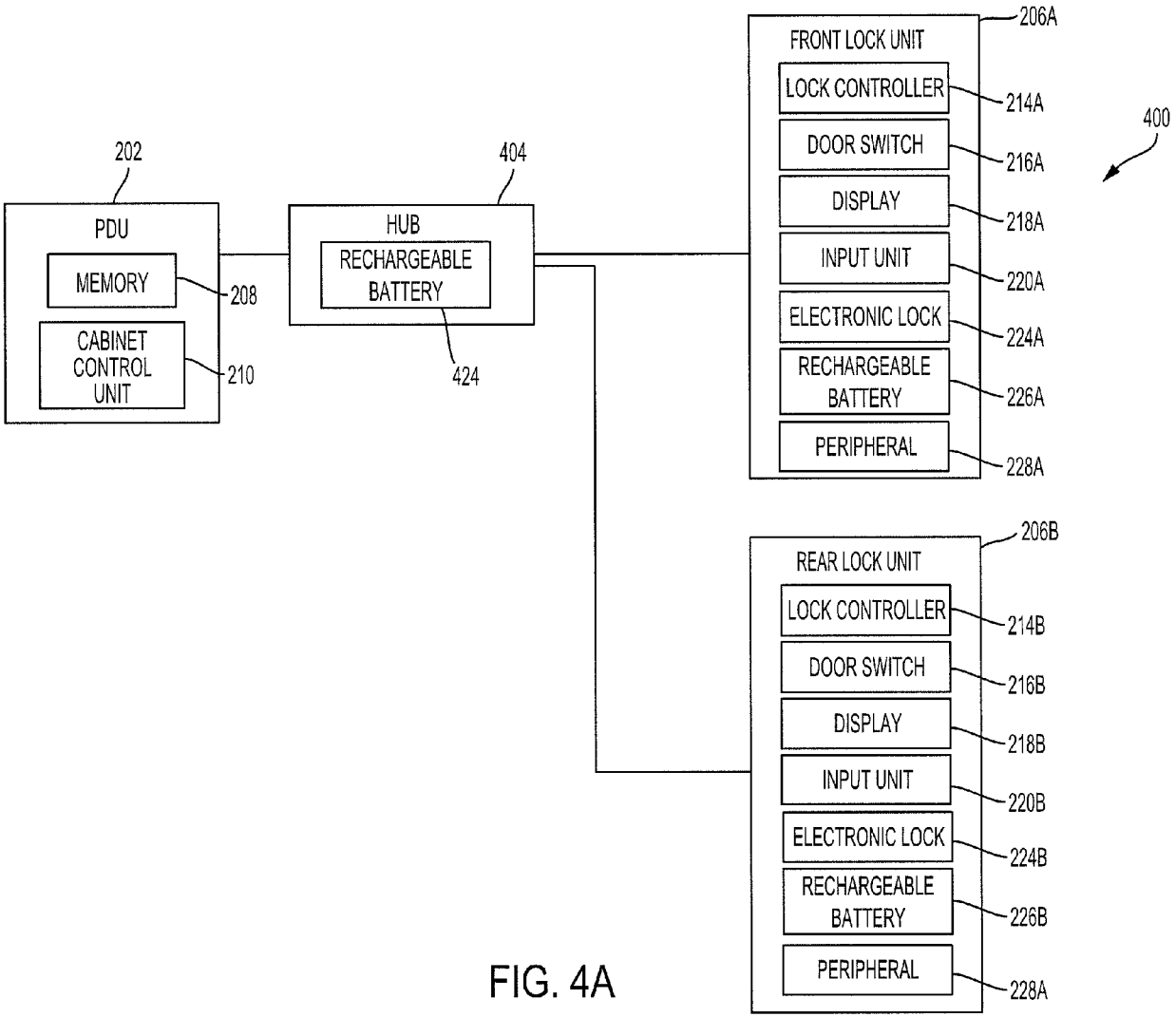
FIG. 4A depicts a block diagram of a remote device with a hub, according to an embodiment of the invention.

FIG. 4A illustrates a block diagram of a cabinet 400, according to an embodiment of the invention. The cabinet 400 includes the PDU 202 and the front lock unit 206A and the rear lock unit 206B. The lock units 206 include, for example, lock controller 214, door switch 216, display 218, input unit 220, electronic lock 224, rechargeable battery 226, and lock unit peripherals 228, as described herein. The PDU 202 of the cabinet 400 is connected to the hub 404, which is connected to the front lock unit 206A and the rear lock unit 206B. The hub 404 may include a rechargeable battery 424 which may be used in case of an interruption of power to the hub 404.

Connections between the PDU 202, the hub 404, and the lock units 206 may be any combination of communications interfaces, such as USB, serial, or Ethernet, or networks, such as CAN. For example, the PDU 202 may be connected to the hub 404 via the USB and the hub 404 may be connected to the lock units 206 via one or more serial connections. In another example, the PDU 202, the hub 404, and the lock units 206 may be connected to each other via one or more serial connections. In yet another example, the PDU 202 is connected to the hub 404 via the USB and the hub 404, the front lock unit 206A and the rear lock unit 206B are connected to a CAN bus and communicate over the CAN bus.

Figure 4B:
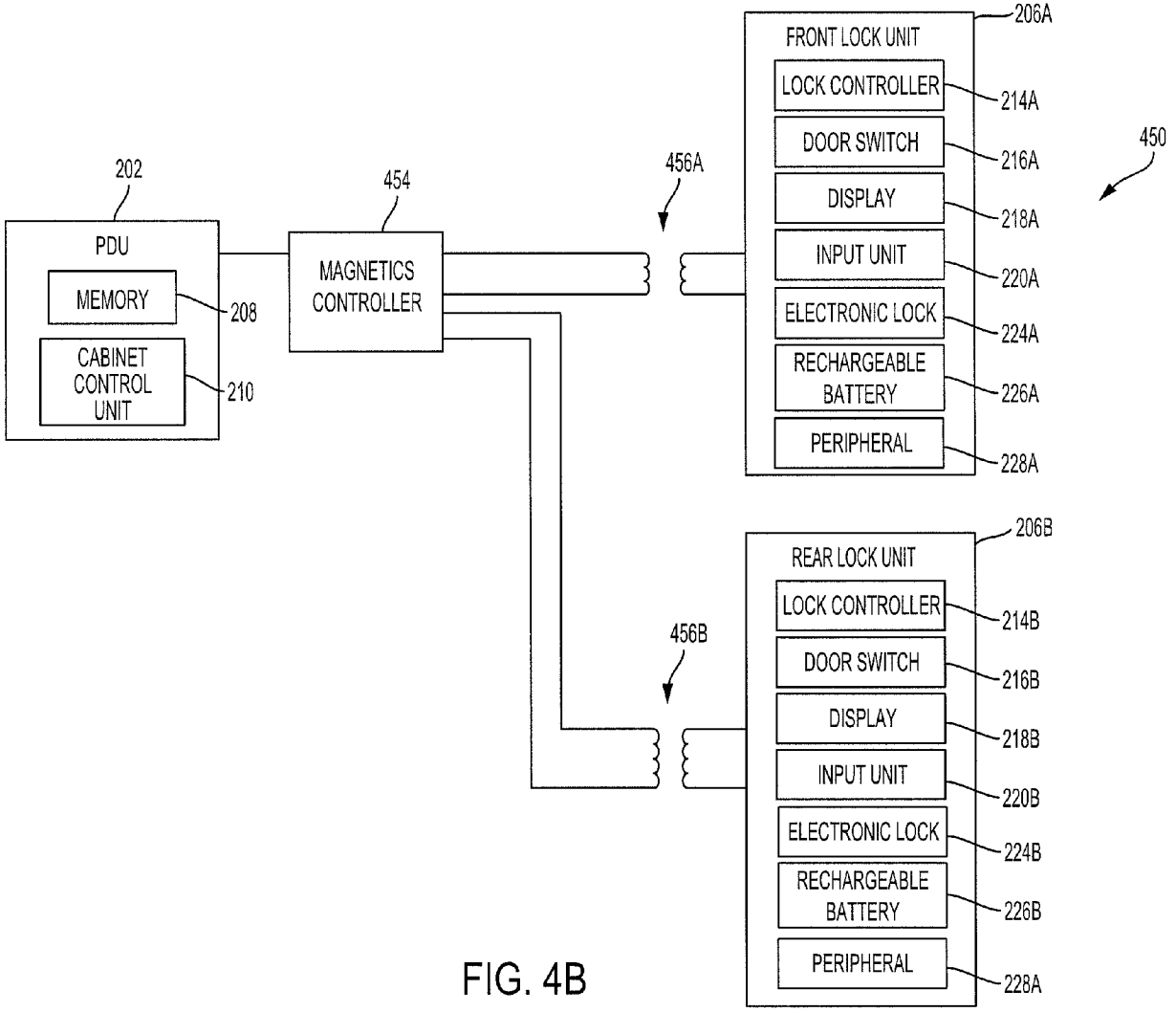
FIG. 4B depicts a block diagram of a remote device with a magnetics controller, according to an embodiment of the invention.

FIG. 4B illustrates a block diagram of a cabinet 450, according to an embodiment of the invention. The cabinet 450 includes the PDU 202 and the front lock unit 206A and the rear lock unit 206B. The lock units 206 include, for example, the lock controller 214, the door switch 216, the display 218, the input unit 220, the electronic lock 224, the rechargeable battery 226, and the lock unit peripherals 228, as described herein. The PDU 202 of the cabinet 450 is connected to the magnetics controller 454 and is connected to the front lock unit 206A and the rear lock unit 206B via one or more inductive couplings 456. Data and power may be communicated between the magnetics controller 454 and the lock units 206 via the one or more inductive couplings 456. When the magnetics controller 454 is connected to the front lock unit 206A and the rear lock unit 206B via the one or more inductive couplings 456, the flexing of the wires across the doors may be obviated. In some embodiments, the magnetics controller 454 may be combined with the input/output unit 204 to provide the capability of connecting the peripherals 212 as well as the inductive coupling of the magnetics controller 454.

Figure 5:
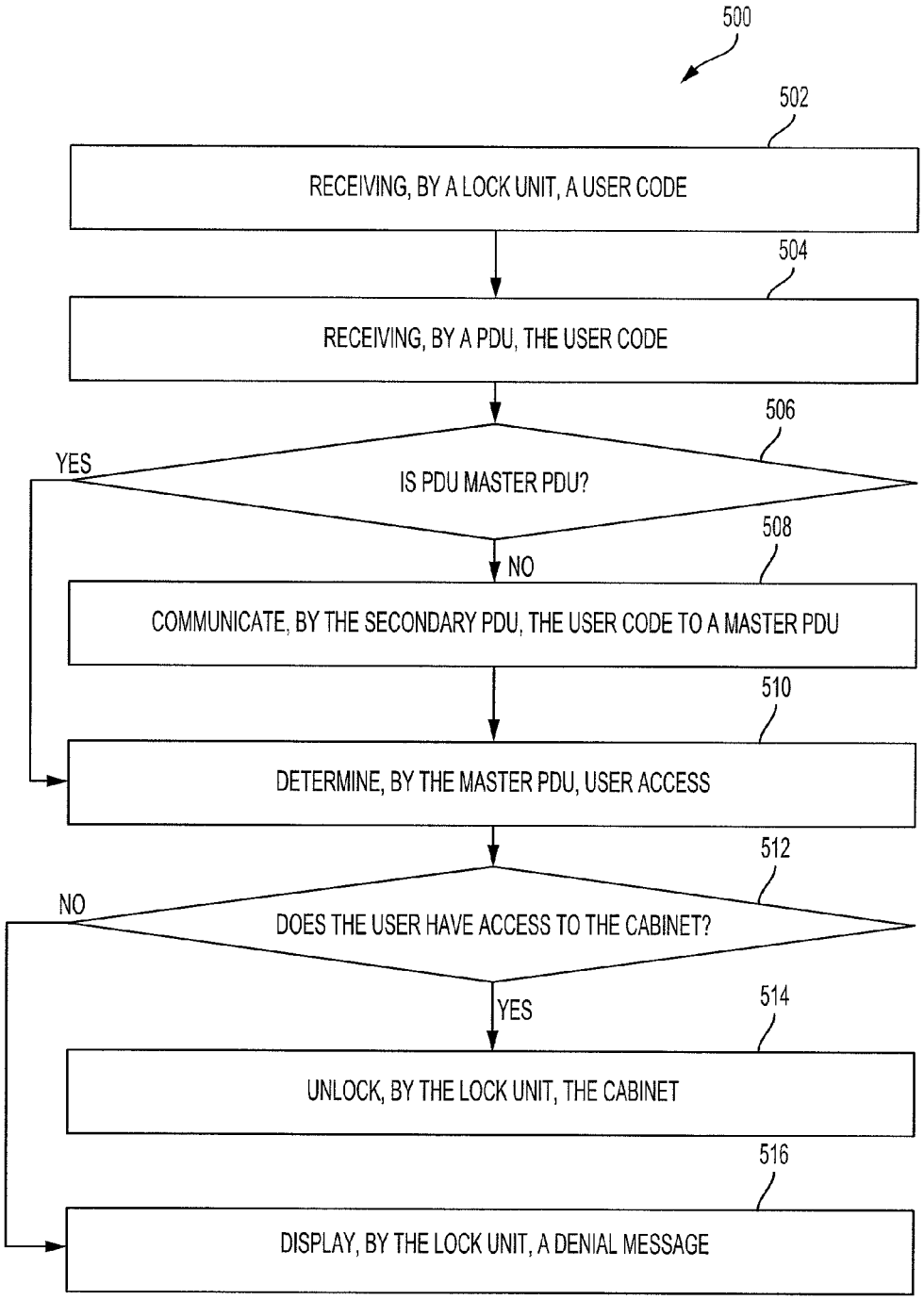
FIG. 5 illustrates an example of a flowchart describing an operation of controlling an electronic lock of a remote device, according to an embodiment of the invention.

FIG. 5 illustrates an example of a flowchart describing a method 500 of controlling an electronic lock of a remote device, such as a cabinet, according to an embodiment of the invention. While the method 500 illustrated in FIG. 5 is described in reference to the system 100 and the cabinet 200, any of the systems described herein may be used.

A lock unit 206 receives a user code (step 502). The lock unit 206 may be a front lock unit 206A, a rear lock unit 206B, or any other lock unit positioned on a cabinet 200. The lock unit 206 receives the user code via an input unit 220. As described herein, the input unit 220 may include any device configured to receive an input from a user, such as a card reader, a keypad, a microphone, or a scanner. In an example embodiment, the user code may be a personal identification number (PIN) associated with the user, and the user may enter the PIN to an input unit 220 having a keypad. In another example embodiment, the user code may be user credentials, such as a username and a password associated with the user, and the user may enter the username and the password to the input unit 220. In yet another example embodiment, the user code may be stored on a physical card and the input unit 220 may include a scanner or a card reader.

The lock unit 206 communicates the received user code to a PDU 202. In some embodiments, the lock unit 206 is connected to an input/output unit 204 or a hub 404, which is connected to the PDU 202 and is configured to facilitate communication between the lock unit 206 and the PDU 202.

The PDU 202 receives the user code (step 504) and it is determined whether the PDU 202 is a master PDU or a secondary PDU (step 506). When the PDU 202 is a secondary PDU, the user code is communicated to a master PDU (step 508). When the PDU 202 is a master PDU, access of a user associated with the user code is determined (step 510). While the method 500 illustrates the master PDU determining user access based on the user code, in some embodiments, any PDU (e.g., master PDU and/or secondary PDU) may determine user access. In these embodiments, each PDU may have a user access table stored in the memory 208.

The PDU 202 determines whether the user associated with the user code has access to the cabinet 200 (step 512). The PDU 202 may compare the user code to the user access table to determine whether the user code is included in the user access table. When the user access table indicates that the user associated with the user code has access to the cabinet 200, the PDU 202 communicates, to the lock unit 206, an indication to unlock an electronic lock of the cabinet 200. As described herein, the electronic lock may be included in the door switch 216 of the lock unit 206 of the cabinet 200. The PDU 202 may communicate the indication to unlock the electronic lock via the input/output unit 204 or the hub 404. The lock unit 206 receives the indication to unlock the electronic lock and unlocks the cabinet (step 514). The PDU 202 may store a log of unlocking instances in the memory 208. The PDU 202 may communicate an indication to the authentication server 108 when the cabinet 200 is unlocked, and the authentication server 108 may store a log and/or may communicate notifications regarding when the cabinet 200 is unlocked.

When the user associated with the user code does not have access to the cabinet 200, the PDU 202 may communicate an indication to display a denial message. The PDU 202 may communicate the indication to display the denial message to the lock unit 206. The lock unit 206 may receive the indication to display the denial message and may automatically configure the display 218 to display the denial message (step 516).

Figure 6:
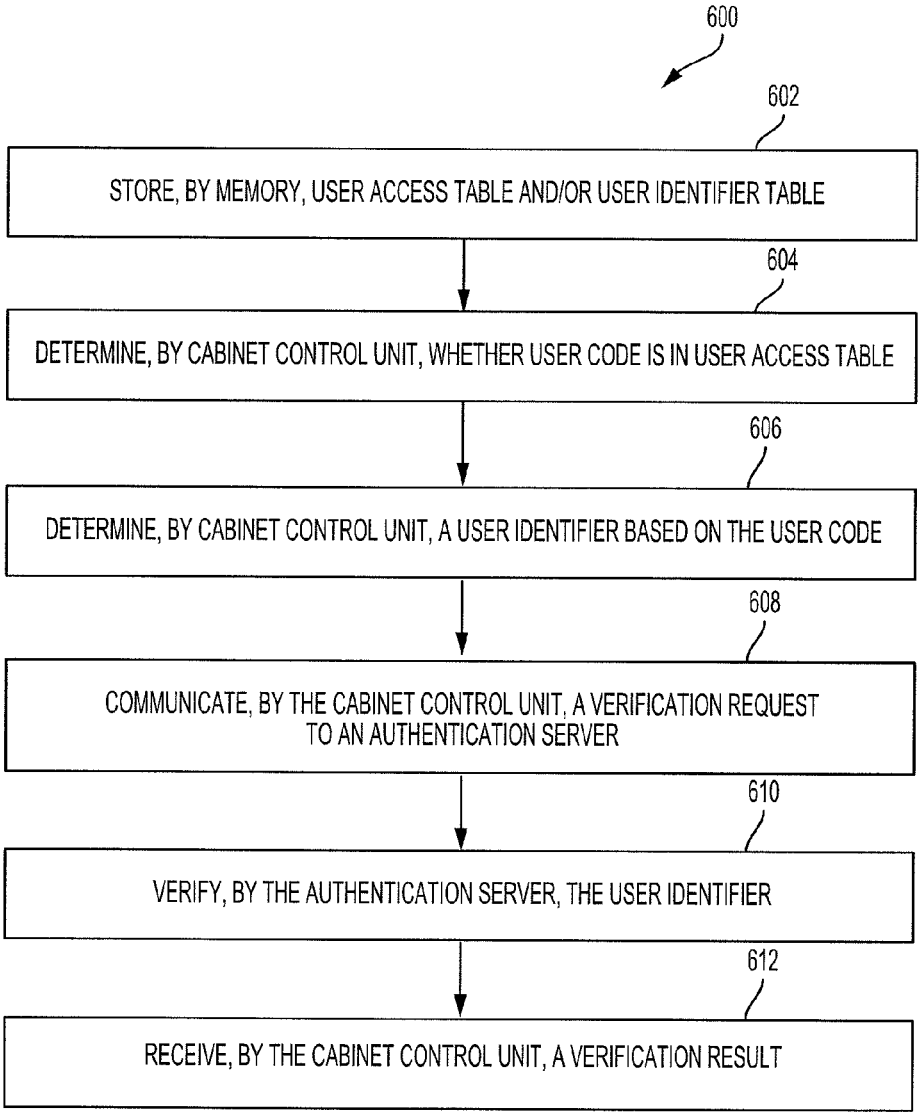
FIG. 6 illustrates an example of a flowchart describing an operation of verifying user access to a remote device, according to an embodiment of the invention.

FIG. 6 illustrates an example of a flowchart describing a method 600 of determining user access to a remote device, such as a cabinet, according to an embodiment of the invention. The method 600 may be used with the method 500. In particular, the method 600 may be performed at step 510 when determining whether a user associated with the received user code has access to the cabinet 200.

The memory 208 stores a user access table and/or a user identifier table (step 602). As described herein, the user access table includes user codes associated with users who have access to the cabinet 200. Also as described herein, the user identifier table provides a user identifier associated with a given user code.

The cabinet control unit 210 determines whether a user code is in the user access table (step 604). The cabinet control unit 210 may compare a user code received from the lock unit 206 against the user access table. In some embodiments, the user access table is a table of user codes, and when a user code is included in the user access table, the user associated with the user code has access to the cabinet 200. In some embodiments, the user access table is a table of user codes and a corresponding indication of whether the user associated with the user code has access or does not have access. In some embodiments, the user access table also includes an indication of a level of access associated with the user. For example, a first user may be allowed access to the cabinet 200, while a second user may be allowed to modify settings associated with the cabinet 200.

The cabinet control unit 210 determines a user identifier based on the user code (step 606). The cabinet control unit 210 may compare the user code received from the lock unit 206 against the user identifier table to determine a user identifier associated with the user code. As described herein, the user identifier may be an identifier that is different from the user code and associated with user permissions.

The cabinet control unit 210 communicates, to an authentication server 108, a verification request (step 608). The verification request may include the determined user identifier. The verification request may also include an identification of the PDU 202 or the cabinet 200. The authentication server may be a remote server accessible to the cabinet control unit 210 over a communications network. Communications between the cabinet control unit 210 and the authentication server 108 may be encrypted using hardware keys, as described herein.

The authentication server 108 receives, from the cabinet control unit 210, the verification request and verifies whether the user associated with the user identifier has access to the cabinet 200 (step 610). The authentication server 108 may store access information associated with the user identifiers and which cabinets users associated with the user identifiers have access to. The authentication server 108 communicates a verification result to the cabinet control unit 210.

The cabinet control unit 210 receives the verification result from the authentication server 108 (step 612). The verification result may include an indication regarding whether the user has access to the cabinet 200. The verification result may be a list of cabinets the user has access to. The cabinet control unit 210 may parse the verification result to determine whether the user has access to the cabinet 200. Once the cabinet control unit 210 has determined whether the user has access, the cabinet 200 may be unlocked when the user has access or a denial message may be displayed when the user does not have access.

Figure 7:
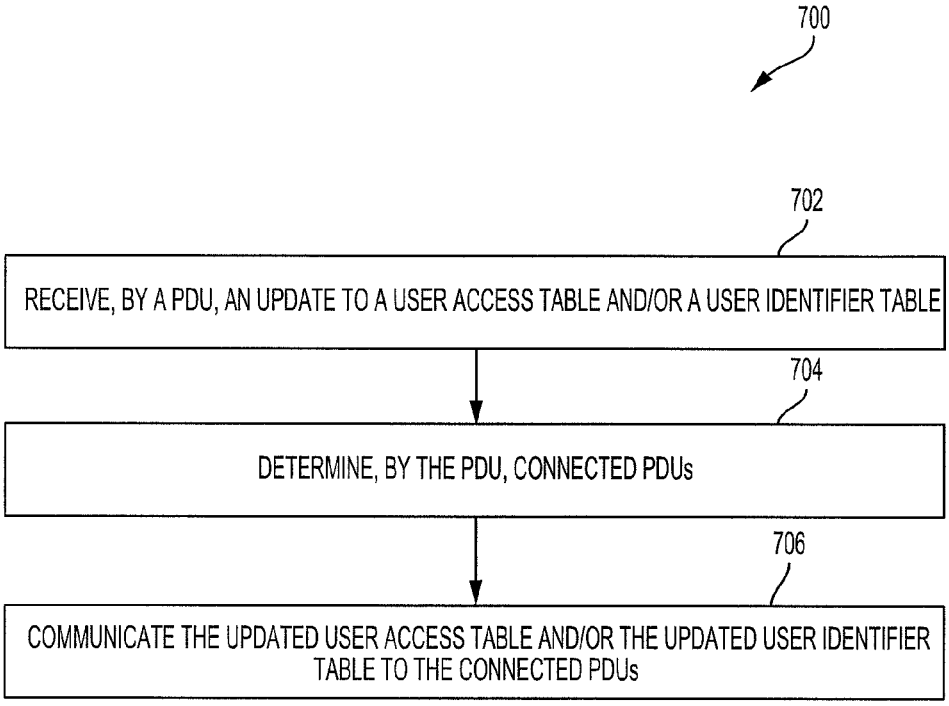
FIG. 7 illustrates an example of a flowchart describing an operation of updating access to a remote device, according to an embodiment of the invention.

FIG. 7 illustrates an example of a flowchart describing a method 700 of updating user access to a remote device, such as a cabinet, according to an embodiment of the invention. The user access table and/or the user identifier table may be updated when user access is granted or removed by an administrator. For example, when a user, such as an employee of a company, is promoted or no longer works for the company, user access may change.

A PDU receives an update to a user access table and/or a user identifier table (step 702). The update may be received from a user device 222 or an authentication server 108.

The PDU 202 determines or identifies other connected PDUs (step 704). For example, as illustrated in FIG. 1, the PDU 202 may be a master PDU 102B, and the master PDU 102B determines or identifies other connected master PDUs (e.g., master PDU 102A and master PDU 102C). Also as illustrated in FIG. 1, the master PDU 102B may determine or identify connected secondary PDUs (e.g., secondary PDU 104C and secondary PDU 104D).

The PDU 202 communicates the updated user access table and/or the updated user identifier table to the connected PDUs (step 706). When the PDU is a secondary PDU, the secondary PDU may communicate the update to an associated master PDU, and the associated master PDU may communicate the update to connected master PDUs and connected secondary PDUs.

Updates to the user access table and/or the user identifier table may be communicated on a periodic basis such that the user access information is not outdated. Updates to the user access table and/or the user identifier table may be communicated whenever a change is made to the user access. As described herein, by communicating updates from one PDU to other PDUs, a need to update the user access table and/or the user identifier tables of multiple PDUs is obviated.

Figure 8:
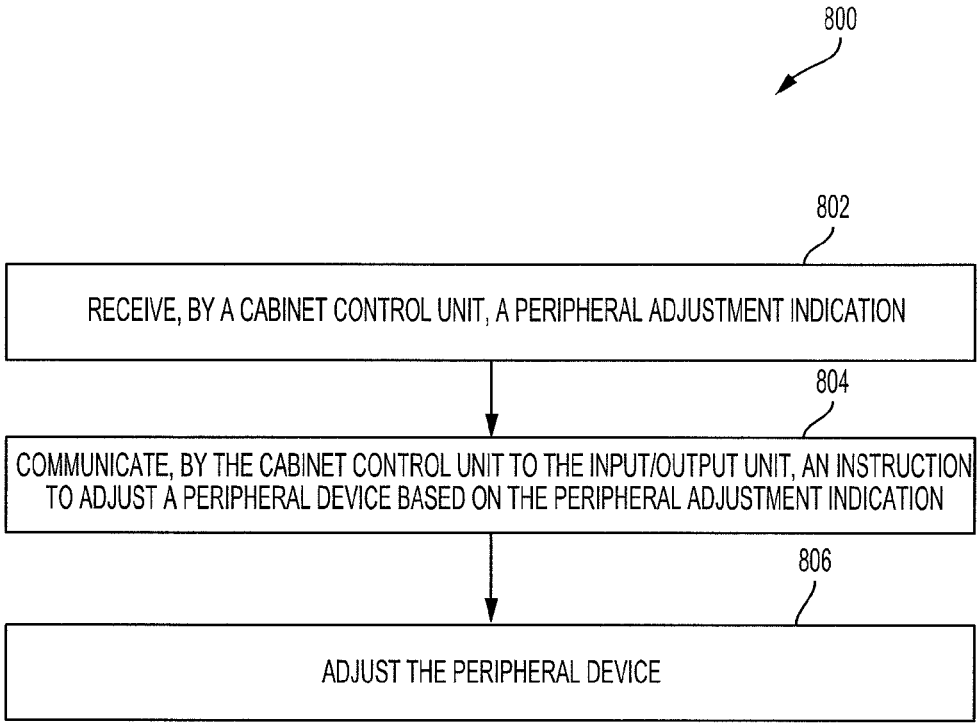
FIG. 8 illustrates an example of a flowchart describing an operation of adjusting aspects of a remote device, according to an embodiment of the invention.

FIG. 8 illustrates an example of a flowchart describing a method 800 of adjusting aspects of a remote device, such as a cabinet, according to an embodiment of the invention.

A user device 222 may be connected to a cabinet control unit 210. The cabinet control unit 210 may provide the user device 222 with a web-based user interface for a user of the user device 222 to configure aspects of the cabinet 200, such as access, temperature, air flow, and humidity. As described herein, aspects of the cabinet 200 may be controlled by peripherals 212 connected to the input/output unit 204.

The cabinet control unit 210 receives, from the user device 222, a peripheral adjustment indication (step 802). The peripheral adjustment indication may include an indication to adjust a target temperature, a target humidity, a target air flow or any other parameter appropriate for the peripheral device.

The cabinet control unit 210 communicates, to the input/output unit 204, an instruction to adjust a peripheral device based on the peripheral adjustment indication (step 804). For example, the peripheral device may be a temperature control unit, and the instruction may be to adjust a target temperature from 70.1 degrees Fahrenheit to 68.9 degrees Fahrenheit.

The input/output unit 204 receives the instruction to adjust the peripheral device and the peripheral device is adjusted (step 806). The user device 222 may be connected to the cabinet control unit 210 wired or wirelessly over a local area network. In this way, a user of the user device 222 is able to adjust aspects of the cabinet 200 using a web-based user interface of the PDU 202.

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that the scope shall not be restricted, except in light of the appended claims and their equivalents.

What is claimed is:

1. A system for controlling an electronic lock to manage access to a cabinet storing an electronic device, the system comprising:

an input unit configured to receive a user code;

a lock controller connected to the input unit and configured to:

lock the electronic lock to restrict access to the cabinet, unlock the electronic lock to allow access to the cabinet, and receive, from the input unit, the user code;

a memory configured to store a user access table of user codes associated with users who have access to the cabinet;

a cabinet hardware encryption chip that is paired with a server hardware encryption chip to encrypt and decrypt communication with an authentication server; and a master power distribution unit connected to the cabinet, the lock controller and the memory and configured to:

provide power to the electronic device stored inside the cabinet, receive, from the lock controller, the user code, determine whether the user code is in the user access table, communicate a verification request that includes the user code to the authentication server using the paired cabinet hardware encryption chip and the server hardware encryption chip to encrypt and decrypt the communication, determine whether a user identifier associated with the user code has access to the cabinet based on the communication with the authentication server, and communicate, to the lock controller, an indication to unlock the electronic lock when the user code is in the user access table and the user identifier is determined to have access to the cabinet.

2. The system of claim 1, wherein the input unit includes a keycard reader configured to detect the user code from a keycard presented to the keycard reader.

3. The system of claim 1, further comprising:

a secondary input unit configured to receive a second user code;

a secondary lock controller connected to the secondary input unit and configured to:

lock a secondary electronic lock to restrict access to a secondary cabinet storing a second electronic device, unlock the secondary electronic lock to allow access to the secondary cabinet, and receive, from the secondary input unit, the second user code; and a secondary power distribution unit connected to the master power distribution unit, the secondary lock controller, and the secondary cabinet, the secondary power distribution unit configured to:

provide power to the second electronic device stored inside the secondary cabinet, receive, from the secondary lock controller, the second user code, communicate, to the master power distribution unit, the second user code, and receive, from the master power distribution unit, an indication to unlock the secondary electronic lock when the second user code is in the user access table.

4. The system of claim 1, further comprising an input/output expander connecting the lock controller and the master power distribution unit, the input/output expander configured to facilitate communication between the lock controller and the master power distribution unit, and provide a connection for a peripheral device.

5. The system of claim 4, wherein the peripheral device is a temperature control unit, and wherein the master power distribution unit is configured to adjust temperature within the cabinet using the temperature control unit.

6. The system of claim 4, wherein the peripheral device is an air control unit, and wherein the master power distribution unit is configured to adjust air flow within the cabinet using the air control unit.

7. The system of claim 4, wherein the peripheral device is a humidity control unit, and wherein the master power distribution unit is configured to adjust humidity within the cabinet using the humidity control unit.

8. A master power distribution unit of a cabinet having an electronic lock and storing an electronic device, the master power distribution unit comprising:

a cabinet hardware encryption chip that is paired with a server hardware encryption chip to encrypt and decrypt communication with an authentication server;

a memory configured to store a user access table of user codes associated with users who have access to the cabinet and the electronic device stored within the cabinet; and a cabinet control unit configured to:

provide power to the electronic device stored within the cabinet, receive, from a lock controller, a user code, determine whether the user code is in the user access table, communicate a verification request that includes the user code to the authentication server using the paired cabinet hardware encryption chip and the server hardware encryption chip to encrypt and decrypt the communication, determine whether a user identifier associated with the user code has access to the cabinet based on the communication with the authentication server, and communicate, to the lock controller, an indication to unlock the electronic lock when the user code is in the user access table and the user identifier is determined to have access to the cabinet, thereby allowing access to the electronic device stored inside the cabinet.

9. The master power distribution unit of claim 8, wherein the user code is detected from a keycard.

10. The master power distribution unit of claim 8, wherein the cabinet control unit is further configured to provide a graphical user interface to a user device.

11. The master power distribution unit of claim 10, wherein the cabinet control unit is further configured to update the user access table based on an indication received from the user device via the graphical user interface.

12. The master power distribution unit of claim 10, wherein the cabinet control unit is further configured to adjust a temperature within the cabinet based on an indication received from the user device via the graphical user interface.

13. The master power distribution unit of claim 10, wherein the cabinet control unit is further configured to adjust an air flow within the cabinet based on an indication received from the user device via the graphical user interface.

14. The master power distribution unit of claim 10, wherein the cabinet control unit is further configured to adjust a humidity within the cabinet based on an indication received from the user device via the graphical user interface.

15. A method of controlling an electronic lock to manage access to a cabinet storing an electronic device, the method comprising:

providing, by a master power distribution unit, power to the electronic device stored inside the cabinet;

receiving by an input unit, a user code;

transmitting, by a lock controller connected to the input unit, the user code to a master power distribution unit;

storing, by a memory, a user access table of user codes associated with users who have access to the cabinet;

determining, by the master power distribution unit, whether the user code is in the user access table;

communicating, by the master power distribution unit to an authentication server, a verification request that includes the user code using a paired cabinet hardware encryption chip and a server encryption chip to encrypt and decrypt the communication;

determining, by the master power distribution unit, whether a user identifier associated with the user code has access to the cabinet based on the communication with the authentication server;

communicating, by the master power distribution unit to the lock controller, an indication to unlock the electronic lock when the user code is in the user access table of user codes and the user identifier is determined to have access to the cabinet; and unlocking, by the lock controller, the electronic lock to allow access to the electronic device stored within the cabinet.

16. The method of claim 15, further comprising receiving, by the master power distribution unit, an updated user access table.

17. The method of claim 16, wherein the updated user access table is provided by the authentication server.

18. The method of claim 16, wherein the updated user access table is provided by a user device connected to the master power distribution unit.

* * * * *